United States Patent [19]

Kronenberg

[11] 4,417,371

[45] Nov. 29, 1983

[54] CLOSURE FOR FLEXIBLE CONTAINERS

[76] Inventor: Kurt Kronenberg, Mühlenbergweg 10, 5485 Sinzig, Fed. Rep. of Germany

[21] Appl. No.: 229,395

[22] Filed: Jan. 29, 1981

[30] Foreign Application Priority Data

Feb. 9, 1980 [DE] Fed. Rep. of Germany ..... 3004884

[51] Int. Cl.[3] ..... B65D 77/10; A44B 21/00

[52] U.S. Cl. ..... 24/30.5 R; 24/461; 24/524

[58] Field of Search ..... 24/30.5 R, 30.5 L, 243 R, 24/16 R, 243 E, 263 R, 263 B, 263 A; 46/90; 128/346, DIG. 24; 150/3, 5, 6; 229/65, 62

[56] References Cited

U.S. PATENT DOCUMENTS

| | | | |
|---|---|---|---|
| 991,167 | 5/1911 | Parkinson | 24/263 B |
| 2,818,095 | 12/1957 | Stahl et al. | 24/263 B |
| 4,046,362 | 9/1977 | Spillers | 24/243 R X |

FOREIGN PATENT DOCUMENTS

| | | | |
|---|---|---|---|
| 2239097 | 2/1974 | Fed. Rep. of Germany . | |
| 13504 | of 1913 | United Kingdom | 24/243 R |

*Primary Examiner*—Mickey Yu

*Attorney, Agent, or Firm*—Martin A. Farber

[57] ABSTRACT

A closure for flexible containers made of hose- or sack-shaped semi-finished products for transporting and storing of flowable or pourable goods, with several rod-shaped or tubular clamps, which are arranged one upon another in side supports and securable in their position to each other and through their separation places one end of the hose- or sack-shaped semi-finished product can be led. In order that the closure can also withstand strong jolt stresses on the filled containers, the clamps are arranged clampable with respect to one another in the supports surrounding their ends and clampable with respect to each other, having one clamping device each which can be inserted into each support.

2 Claims, 5 Drawing Figures

CLOSURE FOR FLEXIBLE CONTAINERS

Figure 1:
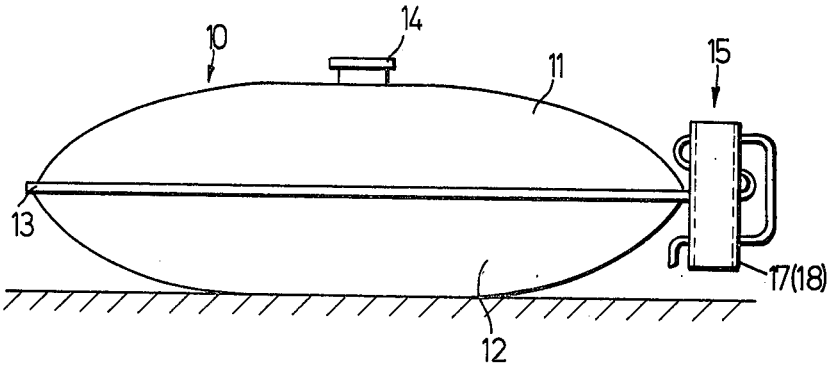

The invention concerns a closure for flexible containers made of hose- or sack-shaped semi-finished products for transporting and storing of flowable or pourable goods, with several rod-shaped or tubular clamps, which are arranged one on top of another in lateral supports and securable to one another in their position, and through their separation places one end of the hose- or sack-like semi-finished product can be led.

Such containers have a capacity of, for example, 2000 liters and are used primarily in disaster cases, for example, supplying people with drinking water. Transportation is usually by means of trucks, whose allowable total weight may not be exceeded. As a result, when using smaller trucks, it can become necessary not to fill the container completely. In this case, however, dynamic mass forces of the liquid could endanger the vehicle during driving, so that a closure is required with which the container can be reduced to the residual volume required for the transported quantity of liquid.

A closure suitable for this purpose and having the characteristics described at the outset is known (German Pat. No. 22, 39 097). This known closure consists of two closure rods which are developed as turning or deflection rods, and which are each allotted one further, outer turning rod spaced and parallel thereto. The turning rods are detachable at at least one of their ends by means of snap-in connections and, at the other end, firmly or detachably joined to one another by means of supports. The folded end of the container is then led through the gap between the two middle turning rods and twice led back in a reverse direction through the gaps between the middle turning rods and their adjacent turning rods. Indeed, this known closure functions satisfactorily during motionless storage or vibrationless transportation, however, it does have the disadvantage that it can still open partially or entirely during strong jolt stresses on the container, thus resulting in leakages.

Proceeding from this point, it is the task of the invention to improve the known closure in such a way that it can be reliably sealed, while retaining a simple and uncomplicated operation, and also withstand strong jolt stresses on the filled container.

This objective is solved for a closure of the kind described at the outset in the manner that the clamps are arranged adjustable relative to one another in the supports surrounding their ends and are clampable with respect to each other, each having one clamping device insertable in each support.

With a practical application, the two supports can be made of U-shaped profiles, between whose arms the clamps are placed. In a further development of the invention, the two supports can be joined to one another with one of the outer clamps to form a rigid U, so that the remaining clamps by the two clamping devices are clampable against the clamp which is rigidly installed and which serves as an abutment.

The clamping device can, in a practical application, be made of an eccentric, which can be inserted into bores of the arms of the two supports with lateral pins. To facilitate handling during insertion into the supports, the eccentric can be arranged on a two-piece case which can be axialy pushed together or compressed against the action of a compression spring, the outer and inner case thereof in the compressed end position can be fixed to one another with a holding pin.

A closure developed according to the invention has, besides a simple operation, the additional advantage that the clamp is not only drawn together by the end of the container wound around it, but is additionally compressed by the clamping devices. This closure cannot open, even when there are strong jolt stresses, as they can, for example, occur when a filled container is thrown off the loading platform of a truck.

Figure 2:
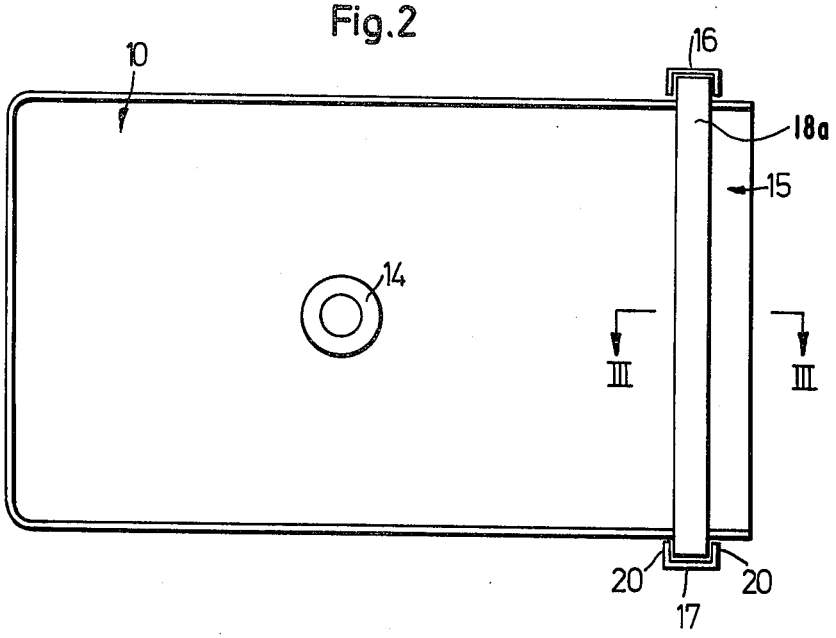
Figure 3:
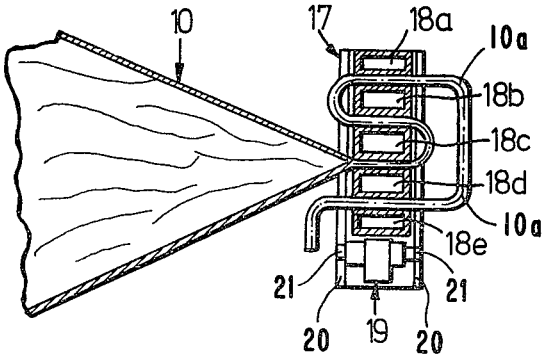
Figure 4:
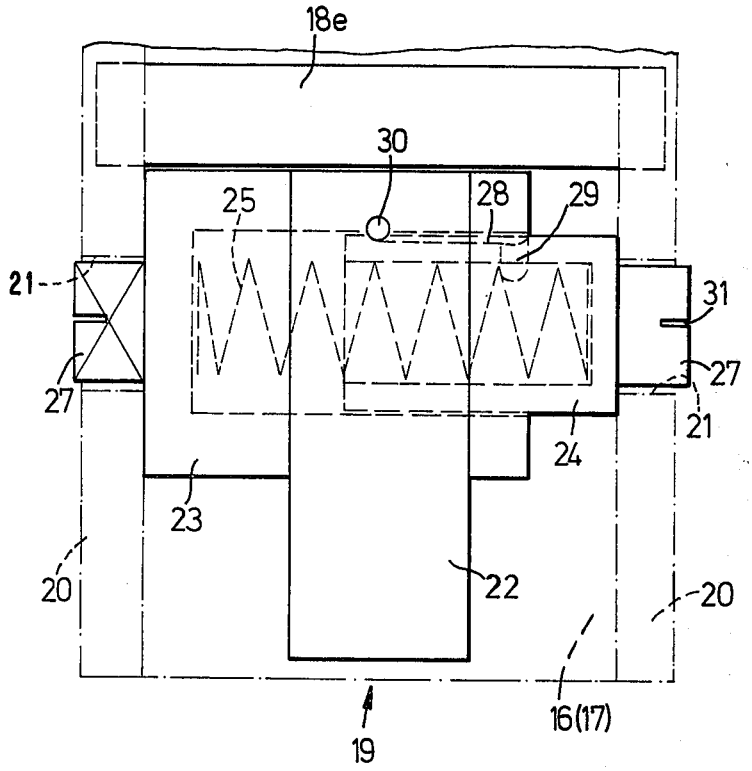
Figure 5:
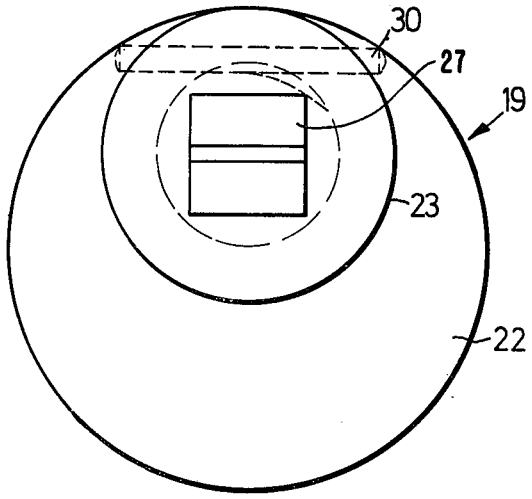

In the accompanying drawings, a preferred application of a closure developed in accordance with the invention has been illustrated. The drawings show:

FIG. 1 a filled container with a closure in side view,

FIG. 2 the same container in top view;

FIG. 3 the closure cut along the line III—III in FIG. 2 in an enlarged representation;

FIG. 4 an axially contactable clamping device in front view;

FIG. 5 the same clamping device in side view.

As a practical example, a sack-like, flexible container 10 has been chosen which comprises an upper part 11 and a lower part 12 and which are joined, for example, adhered or welded to each other, at both their longitudinal sides and at one front side to form a common edge 13. The upper part 11 is provided with a filling opening 14.

The open side of the container 10 is sealed with a closure 15, which is formed of two lateral supports 16 and 17 with a U-shaped cross-section, five tubular clamp members (herein also called clamps) 18*a* to 18*e* and two clamp devices 19.

The two supports 16 and 17 are joined to one another with the outer clamp 18*a* to form a rigid U, the open sides of the profile of both supports 16, 17 face inward toward each other. In this way, the clamps 18*b* to 18*e* which are, cut equally long, can be inserted into the profiles of both supports 16 and 17. In connection with this the folded open end 10*a* of the container 10 is appropriately inserted simultaneously between the clamps 18*a* to 18*e* so that it does not subsequently have to be threaded.

At the free end (the bottom end in the illustrative embodiment), both supports 16 and 17 are provided with bores 21 at equal heights in their arms, in which the clamping devices 19 can be inserted. Each clamping device 19 has an eccentric 22, which is arranged on an outer case 23, an inner case 24 and a compression spring 25 which is arranged between the outer and inner case. Moreover, the outer and inner cases have pins 27 at their ends, with which they catch in the bores 21 of the supports 16 and 17.

In order that the parts of the clamping devices 19 cannot fall to pieces and at the same time also be fixed in their pushed together end position for insertion into the supports 16 and 17, the inner case is provided with an axial extending flattened peripheral portion 28 and a groove 29, which projects from and intersects into the latter. With a support pin 30, which is inserted into the outer case 23 diagonally to the level portion 28, both parts can then be secured to each other. If the outer box 23 and the inner case 24 are turned a little with respect to each other in the pushed together state, the support pin 30 catches in the groove 29 and, in this way, fixes both parts in their pushed together end position. For insertion into the borings 21 of both supports 16 and 17, both parts then just need to be turned a little relative to each other again, so that the compression spring 25 can press the pins 27 into the bores 21.

In order to be able to turn the outer box 23 and inner case 24 relative to one another and to tighten the eccentric 22 against the adjacent clamp member 18*e* so as to clamp the unit, pins 27 are either—as illustrated—provided with slits 31 and/or—as seen in FIG. 5—with a square or multi-side periphery. The square or multi-sided pin must be allotted a corresponding side hole.

In the illustrated example, the container 10 is developed sack-like so that only one closure 15 is required. It is, however, equally possible to use as a container 10 a hose-shaped, semi-finished product, open at both ends, whereby two closures 15 must then be used. With one or more closures 15, the volume of the container 10 can be reduced or increased as desired. It is sufficient therefor to detach the clamping device 19 by turning the eccentric 11. Thereafter, a reduction or increase of the container is already possible.

One or all of the clamp members 18*a*–18*e* can be provided either partially or completely with an anti-friction covering made of rubber or synthetic material (plastic).

I claim:

1. In a closure for flexible containers of semi-finished products adapted for transportation and storage of flowable or pourable goods with several clamp members which are arranged one on top of the other in lateral supports and are securable to one another in their position, and one end of the semi-finished product can be led through separation places of the clamp members, the improvement wherein said supports surround ends of said clamp members, said clamp members are arranged displaceable relative to one another in the supports, clamping means insertable into each of said supports for clamping said clamp members relative to each other, said supports have arms formed with bores, said clamping means each comprises an eccentric member having lateral pins insertable into said bores of said arms of said supports, said eccentric member comprises a two-piece case which is axially telescopical, and compression spring means for biasing said two-piece case.

2. The closure according to claim 1, wherein said two-piece case comprises an outer case and inner case displaceable in the latter, said inner case is formed with an axially extending flattened peripheral portion and a radial groove extending from the latter, a support pin is arranged between said outer case and said inner case and catches in said flattened peripheral portion and said radial groove respectively of said inner case in corresponding positions of the inner and outer case.

* * * * *